US007389731B2

(12) United States Patent
Rudibaugh et al.

(10) Patent No.: US 7,389,731 B2
(45) Date of Patent: Jun. 24, 2008

(54) NON-METALLIC INSERT FOR RAIL CAR BOLSTER WEDGE

(75) Inventors: John W. Rudibaugh, West Chester, PA (US); Charles L. Van Auken, Carlisle, PA (US)

(73) Assignee: ASF-Keystone, Inc., Granite City, IL (US)

( * ) Notice: Subject to any disclaimer, the term of this patent is extended or adjusted under 35 U.S.C. 154(b) by 400 days.

(21) Appl. No.: 11/201,814

(22) Filed: Aug. 12, 2005

(65) Prior Publication Data

US 2007/0034108 A1 Feb. 15, 2007

(51) Int. Cl.
*B61F 3/00* (2006.01)

(52) U.S. Cl. ..... 105/198.5

(58) Field of Classification Search ..... 105/157.1, 105/198.2, 198.3, 198.4, 198.5
See application file for complete search history.

(56) References Cited

U.S. PATENT DOCUMENTS

| | | | | |
|---|---|---|---|---|
| 4,226,188 | A | 10/1980 | Snyder | |
| 4,244,298 | A | 1/1981 | Hawthorne et al. | |
| 4,254,712 | A | 3/1981 | O'Neil | |
| 4,859,089 | A | 8/1989 | Wright | |
| 5,086,707 | A | 2/1992 | Spencer et al. | |
| RE34,129 | E | 11/1992 | Wright | |
| 5,511,489 | A | 4/1996 | Bullock | |
| 5,555,818 | A | 9/1996 | Bullock | |
| 5,943,961 | A | 8/1999 | Rudibaugh et al. | |
| 6,269,752 | B1 | 8/2001 | Taillon | |
| 6,374,749 | B1 * | 4/2002 | Duncan et al. | 105/198.5 |
| 6,688,236 | B2 | 2/2004 | Taillon | |
| 6,701,850 | B2 * | 3/2004 | McCabe et al. | 105/198.5 |
| 6,971,319 | B2 * | 12/2005 | Bowden | 105/198.5 |

* cited by examiner

*Primary Examiner*—S. Joseph Morano
*Assistant Examiner*—Robert J McCarry, Jr.
(74) *Attorney, Agent, or Firm*—Edward J. Brosius

(57) ABSTRACT

Split wedges biased against sloped upper surfaces and the side walls of pockets in the ends of the bolster of a rail car truck are provided with non-metallic wear plates which interface with pocket side walls to reduce or eliminate pocket side wall wear. The wear plates are typically cast polymeric pads selected from the group comprising nylon, Delrin, UHMW and urethane, have a hardness in the range of between about 700° and 900° and a sliding coefficient of friction of about 0.10 to about 0.30. The pads are mounted in recesses within the sidewalls of the wedges and are held in place by means such as threaded fasteners for ease of replacement.

6 Claims, 2 Drawing Sheets

NON-METALLIC INSERT FOR RAIL CAR BOLSTER WEDGE

FIELD OF THE INVENTION

Figure 1:
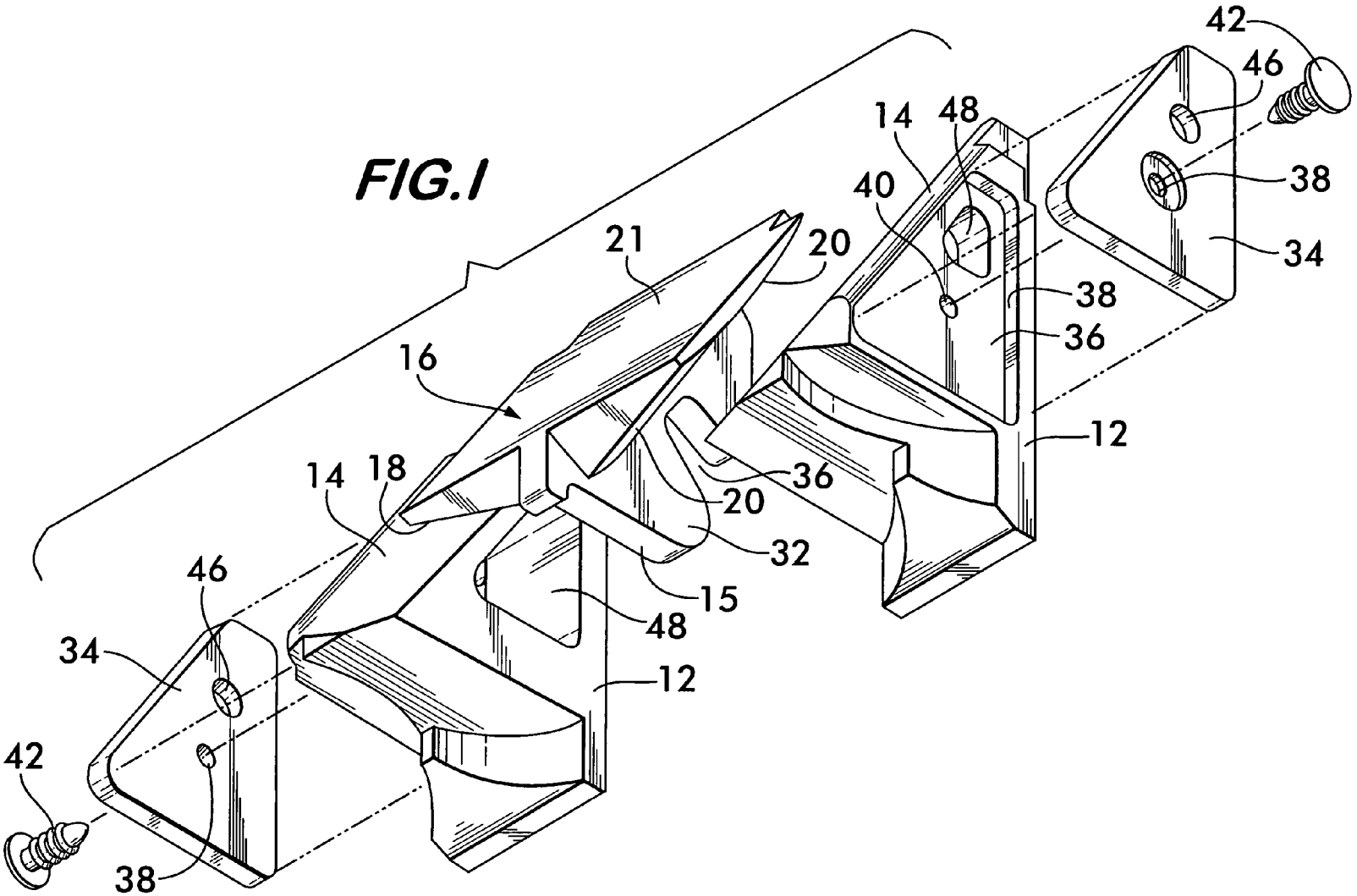

The present invention relates to rail car trucks having a pair of laterally spaced side frames carrying pairs of spaced apart wheel sets wherein each side frame has an opening between the wheel sets for receiving one of the ends of a transversely extending bolster. The ends of the bolster are supported by groups of springs mounted within the side frame openings. More particularly, the invention relates to improvements to wedging devices mounted within the side frame openings for dampening relative motion between the bolster and the side frames, thereby maintaining truck squareness and reducing hunting.

BACKGROUND OF THE INVENTION

In rail car truck assemblies of the type to which this invention relates, it is known to provide friction wedges housed within pairs of bolster pockets located on opposite sides of the bolster adjacent its ends. The friction wedges are preferably provided in pairs which are biased upwardly by springs urging them against a sloped surface within a pocket of the rail car bolster and a wear surface which defines a side frame column at an end of the side frame opening.

In a rail car truck of the type that this invention is particularly applicable to, the bolster pockets have a sloped back surface and use a wear insert bearing on the sloped surface. This wear insert is a separate part which interfaces with correspondingly sloped surfaces of a pair of split wedges. It is known to provide the sloped pocket surfaces with a laterally extending taper or bevel so that the biasing force exerted on a wedge causes it to bear against a side wall surface of the bolster pocket. The wedge action within the pocket thus produces biasing forces jointly against the sloped surface of the pocket, the side edge of the side frame opening and against the pocket side walls generating damping forces which keep the truck square, thereby counteracting truck hunting and reducing wheel wear.

U.S. Pat. No. 4,244,298, issued Jan. 13, 1981, and U.S. Pat. No. 5,943,961, issued Aug. 31, 1999, constitute prior art over which the present invention is an improvement. In these patents, wedges are shown which are split into two side-by-side pieces in spaced relationship to one another. According to both of these patents, the two wedges are biased into full-faced engagement with correspondingly sloped sections of the pocket. In both patents, a side of each wedge section is also biased into face-to-face engagement with a side surface of the bolster pocket side wall.

In U.S. Pat. No. 4,244,298, the sloping surfaces of the pocket are integrally formed with the bolster. In practice, this is accomplished either by welding forged inserts into the pocket having the required shape, by casting the pocket with the corresponding shape or by building up the pocket by welding. In the '961 patent, the problems and expense of the required welding operation are eliminated by providing a removable insert having the required shape which is supported within the pocket without any need for welding it in place.

In service, the forces holding the side of a wedge against the side of the pocket, while increasing the capability of the wedges to square the truck, result in wear of the corresponding pocket side wall. Eventually, during the course of normal use of the truck, this wear may be as great as ⅛" to 3/16" or even more, requiring a rebuild of the bolster pockets.

Rebuilding a worn pocket is a difficult and time consuming operation at best. One method employed is to build up the pocket with molten material by welding, then grinding to the original pocket dimensions the material added by welding. An alternative method is to weld a small wear pad onto the side wall surfaces of the pocket. However, building up the pocket by either of these methods is a difficult proposition because the interiors of the pockets are relatively inaccessible, being only 5-¾" to about 7-½" wide for a typical freight car bolster.

SUMMARY AND OBJECTS OF THE INVENTION

In accordance with the invention, the problem described above is solved by providing a non-metallic insert on the side of the wedge which interfaces with a side wall of the bolster pocket. The non-metallic insert is preferably a polymeric material which eliminates wear on the bolster pocket as there is no metal-to-metal contact, only the contact of the polymer insert against the side wall of the pocket. The non-metallic inserts of the invention are each detachably secured to one side wall of each of a pair of wedges and can be readily easily replaced as necessary when the trucks are periodically inspected. By the use of such inserts, it is reasonably expected that the bolster pocket will last for the life of the rail car.

The use of such inserts achieves the objective of substantially reducing maintenance costs and prolonging the life of truck components, while promoting squareness of the truck and achieving thereby a reduction of wheel wear.

The foregoing and other objects and advantages of the invention will be apparent from the following detailed description of a preferred embodiment, taken in conjunction with the accompanying drawings. dr

DETAILED DESCRIPTION OF THE DRAWINGS

Figure 2:
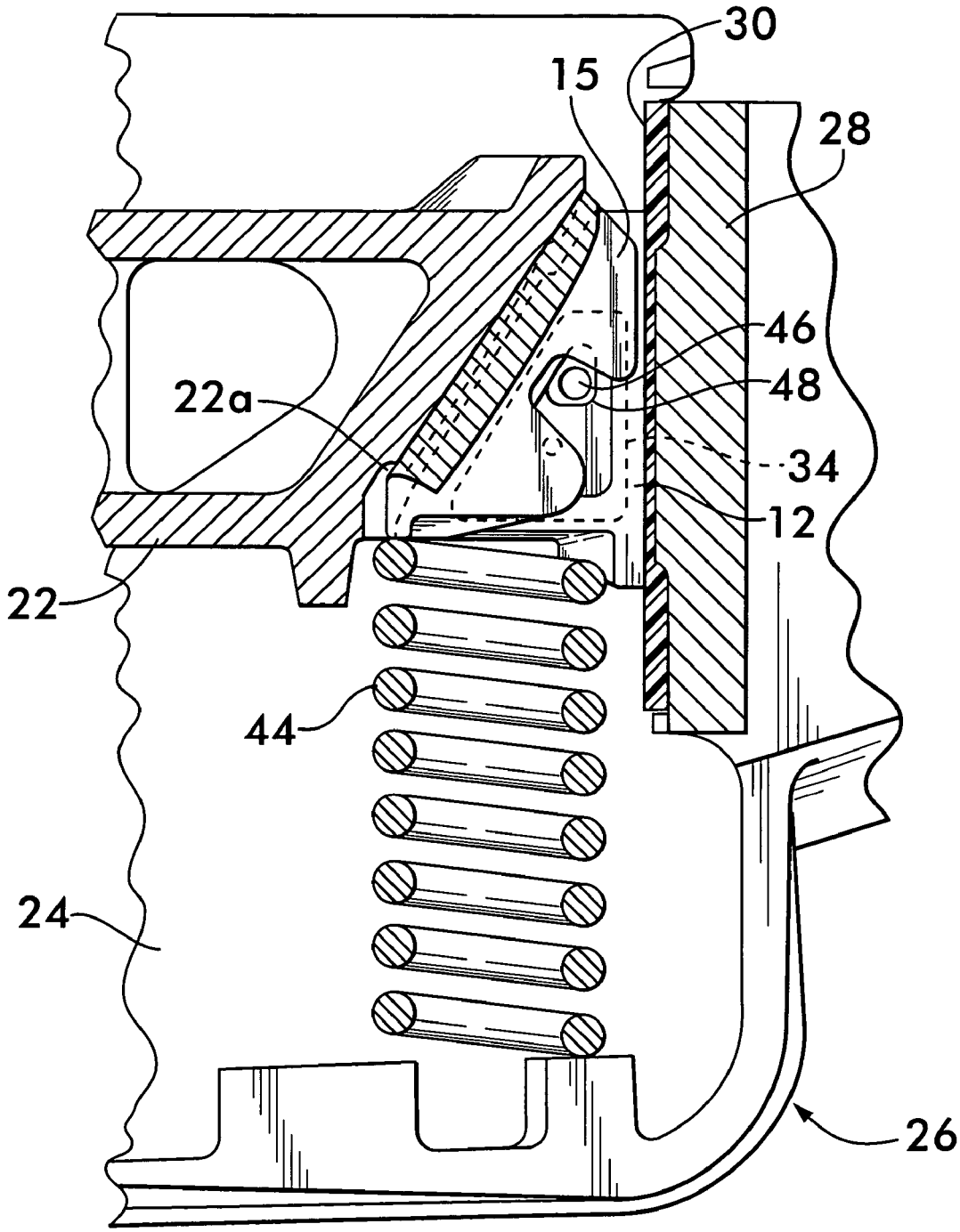

FIG. 1 is an exploded perspective view of a preferred form of split wedge assembly incorporating the principles of the present invention; and FIG. 2 is a fragmented side view, partly in section, illustrating a fragment of the truck side frame and the bolster pocket with a split wedge assembly in place.

DETAILED DESCRIPTION OF THE PREFERRED EMBODIMENTS

FIG. 1 is a view of a prior art wedge assembly of the type shown in U.S. Pat. No. 5,943,961, modified to include the teachings of the present invention. As illustrated in FIG. 1, the wedge assembly preferably comprises a pair of split wedges 10 and 12 each having an upwardly facing sloped load bearing surface 14. The split wedges are seen in FIG. 1 as separated by web 15 of an insert 16 which fits within one of a pair of pockets 22*a* in a bolster 22 shown in FIG. 2. As shown in FIG. 1 of the instant application, insert 16 has a pair of sloped surfaces identified respectively by the reference characters 18 and 20 and an upwardly facing sloped surface 21 which bears against the sloped back wall of pocket 22*a*. The sloped surfaces 18 and 20 further slope outwardly towards the side edges of the insert away from the centrally located web 15 towards the side edges of the pocket and extend inwardly into the space at the back of the pocket. In the assembly illustrated, the insert 16 is completely unattached to the pocket 22*a*, but its upper surface 21 is intended to be in face-to-face contact with the sloped back wall of the pocket. In other assemblies as, for example, in the assembly of the '298 pocket, the wedges may bear directly against the sloped back wall of the pocket or against an insert which is welded to or otherwise attached to the back wall. As can be seen in FIG. 1, the insert 16 is beveled away from its central portion towards the side edges thereof.

FIG. 2 is a view looking towards a truck side frame 26 with the end of bolster 22 shown in section. The bolster 22 extends transversely of a pair of side frames with each end projecting laterally through the side frame opening 24. Only one such side frame, the side frame opening and a portion of the bolster are illustrated in FIG. 2. Each end of the bolster has a pair of the pockets 22*a* facing towards opposite sides of a side frame opening 24.

With further reference to FIG. 2, each side frame 26 further includes spaced apart side frame columns 28, only one of which is illustrated. Each column 28 has a wear surface 30 which projects inwardly into opening 24 in facing relationship with a bolster pocket 22*a*. As noted above, the insert 16 has a centrally located dividing web 15. Split wedge 12, facing away from the viewer, is shown in side view in FIG. 2 with its side positioned behind the web 15. Both wedges are supported by biasing means such as one or more coil springs 44. As illustrated in FIG. 2, one wedge can be seen with its opposite side bearing against that side of the bolster pocket 22*a* away from the viewer. As explained in more detail in U.S. Pat. No. 5,943,961, and seen in FIG. 1, the split wedges are biased against the respective surfaces 18 and 20 on insert 16. The split wedges are also biased outwardly against the side walls of bolster 22*a*.

In FIG. 1, one of the pair of pads 34 is shown positioned to fit within a recess 36 in the side of wedge 12, it being understood that second, similarly shaped pad 34 is attached within a similarly shaped recess in the side of wedge 10 facing away from the viewer. The pads 34 serve as wear members which interface with the side surfaces of a bolster pocket 22*a*. Pads 34 are formed of a non-metallic material, a preferred material being a polymer, as discussed further below. The pad thickness is such that it projects beyond the side surface of the wedge by a significant amount and provides the entire contact surface for the wedge with the bolster pocket side wall. In the presently preferred embodiment of the invention, the recess in each wedge is about 0.25" deep and the pad has a thickness of 0.31", thus allowing the outer surface of the pad to project beyond the outer surface of the wedge by about 0.06". Once the pad has worn to the point where wear of the side surface of the wedge is likely to soon occur, the pad will be ready for replacement.

In order to secure the pads within the recesses in the wedges, each pad 34 is preferably provided with a countersunk hole 38 generally centrally located in alignment with a threaded bore 40 in the side wall of the wedge. A flat headed threaded fastener 42 fits within hole 38 and is threaded into threaded bore 40 to attach the pad to the side wall of the wedge. The head of the fastener should be flush with the wedge surface or slightly recessed when the fastener is tightened. Preferably, the fasteners are made of the same material as the pad. If a metal fastener is employed, the hole 38 should be countersunk sufficiently to avoid contact of the fastener head with the pocket side wall under normal conditions of wear. The pad also has a hole 46 aligned with openings 48 in the split wedges 10 and 12 and the recess 36 in the web of the insert for temporary insertion of a locking pin used during installation as explained in the '961 patent.

In the preferred embodiment of the invention, the pads are formed of nylon, although other wear resistant polymers such as Delrin, urethane or UHMW may be employed. By UHMW is meant ultra high molecular weight polyethylene preferably having a molecular weight of between about 3 and about 6 million. The pads preferably have a hardness in the range of about 700 to about 900 and most preferably a hardness of about 800.

Pads made from such materials may be provided by casting or molding.

In use, the wedges 10 and 12 are biased upwardly by biasing means such as the coil springs 44 against the sloped surfaces 18 and 20 within pocket 22*a*, the wear surface 30 and the pocket side walls, thereby providing support for the bolster and the car body and providing damping forces which promote truck squareness and reduce hunting. With the use of the wear resistant, non-metallic pads, wear of the pocket side walls is substantially eliminated. The pads 34 are extremely durable and exhibit little wear in use but are, nevertheless, readily replaceable if observable wear is encountered. The pads are relatively inexpensive, can be changed quickly and easily without the need for welding and, with periodic inspection and replacement when necessary, are expected to extend the life of the bolster pocket indefinitely.

What is claimed is:

1. For use in a freight car truck having a pair of laterally spaced side frame members supporting plural spaced wheel sets, each side frame having a side frame opening between said wheel sets for receiving the projecting ends of a freight car bolster spanning said side frames, each said side frame opening including longitudinally spaced apart opposed friction surfaces disposed on opposed sides of a projecting end of the bolster, said projecting bolster ends having a pair of pockets, each of said pockets facing one of said friction surfaces, said pockets including a sloped back surface part sloping downwardly and inwardly and substantially flat vertically oriented side walls, said sloped back surface part being tapered from a central raised portion towards the sides of the pocket and a pair of wedges disposed within each said pocket, each said wedge having inclined surfaces disposed within said bolster pocket, said wedges being spaced apart with the inclined surfaces disposed on opposite sides of central raised portion with the inclined surfaces interengaging with the sloped surfaces of the sloped back surface part and the vertical surface engaged with one of said longitudinally extending friction surfaces, each said tapered surface cooperating with a corresponding inclined wedge surface to bias said wedge into engagement with the corresponding side wall of the pocket, and biasing means for biasing said wedges upwardly between the associated friction surface and the sloped surface of the back surface part, the improvement comprising a polymeric wear pad attached to a vertically disposed side of the wedge, each said wear pad being disposed for interengagement with said pocket side wall with said pad having a wear surface serving as the sole wear surface between the wedge and the pocket side wall, and wherein the vertically disposed surface of the wear pad comprises a recess generally conforming to the shape of the pad, said recess receiving the pad, the pad having a thickness greater than the depth of the recess whereby the pad surface extends beyond the recess, and wherein said recess and said wear pad have a generally triangular shape with the base of the triangle being disposed along the bottom surface of the wedge.

2. A wedge assembly according to claim 1, further including means for detachably securing the wear pads to the sides of the wedges.

3. A wedge assembly according to claim 2, wherein the means of detachably securing the pad to the wedge comprises a fastener made from the same material as the pad, a bore extending through the pad, said bore being countersunk, said fastener having a head recessed within the countersunk portion of the bore flush with the pad wear surface.

4. A wedge assembly according to claim 1, wherein the wear pads are comprised of a polymeric material selected from the group comprising nylon, Deirin, UHMW and urethane.

5. A wedge assembly according to claim 4, wherein the wear pads are cast.

6. A wedge assembly according to claim 1, wherein the pad surface projects beyond the recess by a distance of about 0.06".

* * * * *